United States Patent [19]

Saito

[11] Patent Number: 4,730,354

[45] Date of Patent: Mar. 15, 1988

[54] GLOVE

[76] Inventor: Edwin T. Saito, 3628 Aliamanu St., Honolulu, Hi. 96818

[21] Appl. No.: 19,428

[22] Filed: Feb. 26, 1987

[51] Int. Cl.[4] ..... A41D 19/00

[52] U.S. Cl. ..... 2/161 A; 2/159

[58] Field of Search ..... 2/161 A, 161 R, 160, 2/159, 162, 16; 273/188 R, 183 B

[56] References Cited

U.S. PATENT DOCUMENTS

| | | | |
|---|---|---|---|
| 2,522,344 | 9/1950 | Carmin | 2/161 A |
| 3,262,126 | 7/1966 | Price | 2/159 |
| 3,918,097 | 11/1975 | Mlodoch . | |
| 4,057,255 | 11/1977 | Bishop . | |
| 4,247,097 | 1/1981 | Schwartz | 2/161 A X |
| 4,438,532 | 3/1984 | Campanella et al. | 2/161 A X |
| 4,445,507 | 5/1984 | Eisenberg | 2/161 A X |
| 4,546,495 | 10/1985 | Castillo . | |
| 4,565,195 | 1/1986 | Eisenberg . | |

FOREIGN PATENT DOCUMENTS

| | | | |
|---|---|---|---|
| 278428 | 10/1927 | United Kingdom | 2/161 A |

*Primary Examiner*—Louis K. Rimrodt

*Assistant Examiner*—J. L. Olds

*Attorney, Agent, or Firm*—Henderson & Sturm

[57] ABSTRACT

A sporting glove adapted to extend over the hand of a human being, the glove including finger covering portions, a thumb covering portion, a palm covering portion, a wrist covering portion and a portion for covering the back of the hand wherein all of the portions are interconnected together. The glove has a pair of slots on the front and back adjacent to the thumb and a strap having one end with a metal "D" ring attached thereto which is positioned adjacent the wrist covering portion and such one end extends around the base of the thumb covering portion and leads to one of the pairs of slots on the back of the glove, over and between the thumb covering portion and the adjacent finger covering portion and through the other pair of slots on the palm covering portion. The strap then leads down around the base of the thumb, around the back of the wrist and still extending around to the front of the wrist wherein the other end of the strap extends through the metal "D" ring on the one end of the strap, reverse pulled and is held in that position by hook and pile type VELCRO fasteners attached to the strap itself.

1 Claim, 6 Drawing Figures

GLOVE

TECHNICAL FIELD

The present invention relates generally to gloves, and more particularly to a glove having a wrist brace attachment thereto for allowing the user to obtain more power from the hand during certain sporting and working activities.

BACKGROUND ART

Prior art gloves fit over the hand and give a certain comfort, feel, appearance and grip. Gloves are designed to eliminate the problems of perspiration, blisters, callouses and generally to protect the hand. Glove manufacturers generally try to make their products more durable, softer to the feel, and more confortably fitting to the hand for a better grip and feel and for a solid gripping action.

Since grip is an important aspect of a glove, most gloves made today are extremely thin for enhancing that feel. This combination of grip and feel is considered by many to add power to the hand, for example, when playing golf, tennis or other sports. Certain type fitting designs, half-cut finger gloves, palm wedges, sandy and tacky materials added to the glove, strips to tighten fingers to the palm, etc., do not give power to the hand, although they may enhance the grip of the club, racket or the like.

The natural state of the hand allows the wrist to rotate three hundred and sixty degrees or to bend basically forwardly, rearwardly, to one side or the other or in any combination of these directions. The problem is that there is nothing available to hold the hand in a certain angle with respect to the wrist or to adjust this angle to some extent. Consequently, there is a need for such an apparatus which would increase the power available from the wrist to the hand under certain circumstances.

Disclosure of the Invention

The present invention relates to a sporting glove adapted to extend over the hand of a human being, the glove including finger covering portions, a thumb covering portion, a palm covering portion, a wrist covering portion and a portion for covering the back of the hand wherein all of the portions are interconnected together. The glove has a pair of slots on the front and back adjacent to the thumb and a strap having one end with a metal "D" ring attached thereto which is positioned adjacent the wrist covering portion and such one end extends around the base of the thumb covering portion and leads to one of the pairs of slots on the back of the glove, over and between thumb covering portion and the adjacent finger covering portion and through the other pair of slots on the palm covering portion. The strap then leads down around the base of the thumb, around the back of the wrist and still extending around to the front of the wrist wherein the other end of the strap extends through the metal "D" ring on the one end of the strap, reversed and pulled and is held in that position by hook and pile type VELCRO fasteners attached to the strap itself.

An object of the present invention is to provide a wrist support apparatus to prevent injury for safety.

Another object of the present invention is to provide a glove having a wrist supporting apparatus attached thereto, to hold and control the hand.

A further object of the present invention is to provide a wrist supporting glove which will hold the hand at a certain angle with respect to the forearm and wherein such angle can be adjusted to some extent.

Another object and feature of the wrist supporting apparatus is to give essential reminders of hand position in a swing or stroke.

A further object of the present invention is to provide a braced wrist angle-type glove which will increase the power of the hand, for example, by golfers, tennis players or the like.

Other objects, advantages, and novel features of the present invention will become apparent from the following detailed description of the invention when considered in conjunction with the accompanying drawings.

BEST MODE FOR CARRYING OUT THE INVENTION

Figure 1:
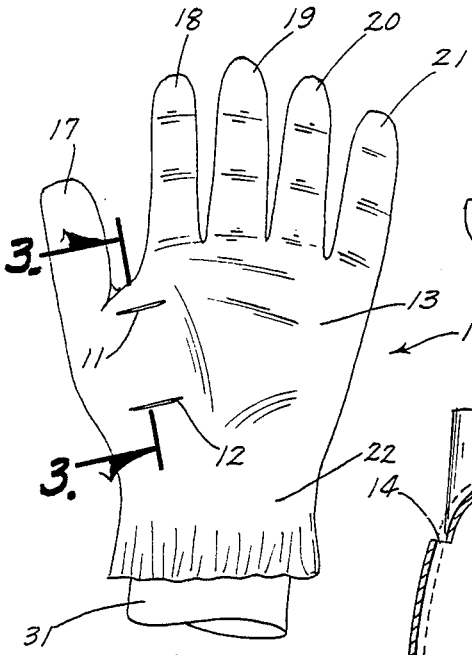
FIG. 1 is a front view of a glove constructed in accordance with the present invention.

Referring now to the drawings, wherein like reference numerals designate identical or corresponding parts throughout the several views, FIG. 1 shows a glove (10) which can be made of leather, nylon or many other materials and which has a first pair of slots (11 and 12) in the palm portion (13) of the glove (10) and a second pair of slots (14 and 15) on the backside of the glove (16) adjacent a thumb covering portion (17). The glove also includes finger covering portions (18, 19, 20 and 21) and a wrist covering portion (22).

A strap (25) has a D-shaped metal ring (26) secured thereto by one end (27) which is looped therethrough and then sewn together. The other end of the strap (25) includes a first looped hook type VELCRO section (28) and a second pile type VELCRO section (29) of a complementary type so that when portion (28) is pressed against (29), it will be held together in a well known fashion, but it can be pulled apart also in a well known fashion.

Figure 2:
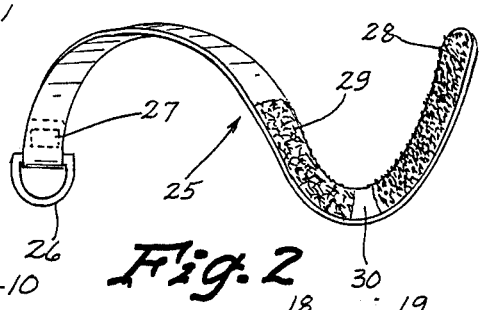
FIG. 2 is is a perspective view of a strap utilized in the present invention.
Figure 3:
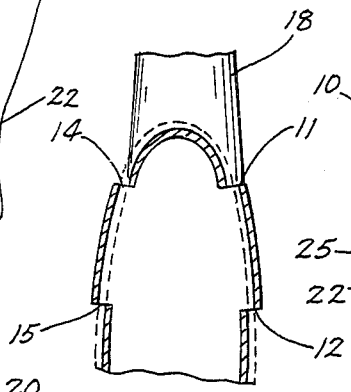
FIG. 3 is an enlarged, partial cross-sectional view taken along line 3—3 of FIG. 1.
Figure 4:
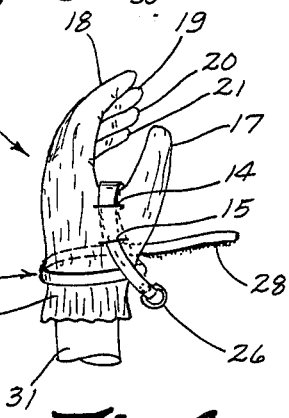
FIG. 4 is a side elevational view of the glove of FIG. 1 with the strap of FIG. 2 being attached thereto.
Figure 5:
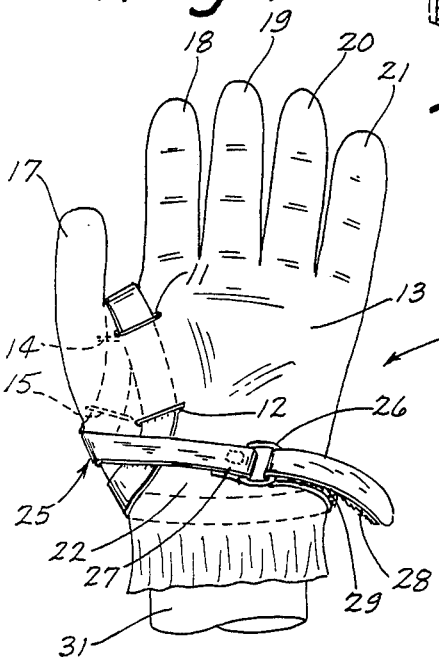
FIG. 5 is a front view like FIG. 1, but showing the strap of FIG. 2 installed thereon.

The strap (25) is positioned on the glove by threading the end having the hook type VELCRO section (28) thereon through the slots (15, 14, 11 and 12) in that order, leaving just enough of the end (27) having metal "D" ring or loop (26) thereon so that the metal "D" ring will be in the position shown in FIG. 4. The strap (25), as it extends out of slot (12) is then wrapped around back of the wrist section (22) of the glove and then back around the front of the wrist section (22) and through the metal "D" ring section (26) so that it can be fastened together in the position shown in FIGS. 5 and 6 by pressing the hook and pile type VELCRO sections (28 and 29) together. The strap (25) is preset so the metal "D" ring (26) will be at the space portion (30) of the strap (25) as shown in FIG. 2, to hold the hand at a certain angle with respect to the forearm (31). But this angle can be changed to some extent by lengthening or shortening the distance between the metal "D" ring (26) and the right hand side of glove (10) as viewed in FIG. 5, by pulling the strap (28) tighter or alternatively, making it looser before the hook and pile type VELCRO sections (28 and 29) are attached together.

Figure 6:
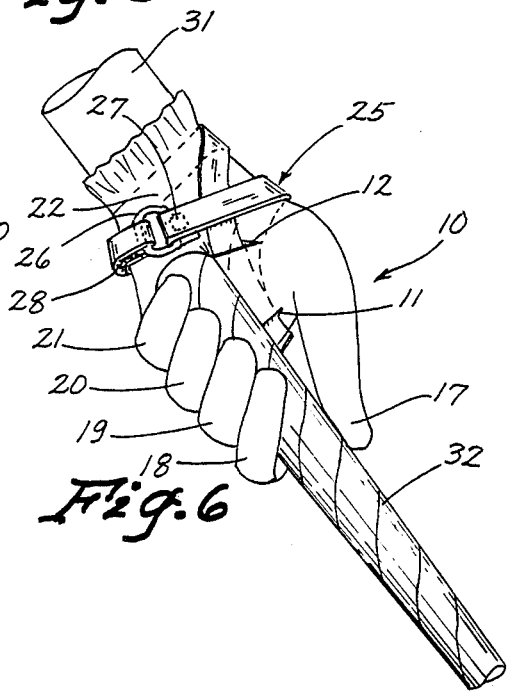
FIG. 6 is a view of the preferred embodiment of the present invention shown in use holding a golf club.

Once the angle of the hand has been adjusted with respect to the forearm (31) by positioning the hook type VELCRO section (28) with respect to the pile type VELCRO section (29), then a golf club handle (32) or the like can be grasped in the fashion shown in FIG. 6 and when such golf club is used, more power will be imparted to the handle (32) during the swing and impact thereof with the ball because the wrist will not be allowed to flex as much as it would without the strap (25). Furthermore, if a golfer were to hit the ground or a rock for example, the wrist would be supported and be less likely to be injured under such circumstances.

Obviously, many modifications and variations of the present invention are possible in light of the above teachings. For example, nearly any sport which uses the hands can utilize the apparatus shown in FIG. 5 to increase the power from the hand by preventing flexing of the wrist and by holding the wrist in a desired position. Furthermore, such principles can be used in certain occupations where power from the wrist is important or where it is desirable to support the wrist and prevent the hand from bending when the hand is used. Obviously, a right hand model not shown, can be used instead of the left-hand model shown. It is therefore to be understood that, within the scope of the appended claims, the invention may be practised otherwise than as specifically described.

I claim:

1. A sport apparatus comprising:

a glove adapted to extend over the hand of a human being, said glove including four finger covering positions, a thumb covering portion, a palm covering portion, a portion for covering the back of a hand and a wrist covering portion wherein all of said portions are interconnected together;

a strap having a metal "D" ring on one end;

a first hook type fastening section on one side of one end of said strap;

a second pile type fastening section means on an intermediate portion of one end of said one side of the strap for selectively attaching or detaching the first hook type fastening section to the second pile type fastening section means;

a first pair of parallel slots disposed in the palm covering portion, said first pair of parallel slots being generally transversely disposed with respect to the longitudinal direction of the thumb covering portion;

a second pair of slots disposed in the portion of the glove for covering the back of the hand; and said strap extending through said first and second pair of slots and over the glove between the thumb covering section and the adjacent finger covering section, said strap also extending from said pair of slots to said ring on said one end, said ring being positioned over a portion of said wrist covering portion, said strap also extending from said first pair of slots over the base of the thumb covering portion, around the back of the wrist covering portion and around the front of the wrist covering portion, said strap extending through said metal "D" ring and doubled back with a firm pull to engage the first hook type fastening section with the second pile type fastening section means for holding the glove and any hand therein from movement with respect to the wrist section, said strap criss-crossing on the wrist covering portion of the glove adjacent to the palm covering portion.

* * * * *